US009377200B2

(12) United States Patent
Sandelis

(10) Patent No.: US 9,377,200 B2
(45) Date of Patent: Jun. 28, 2016

(54) TURBOMACHINE COMBUSTION CHAMBER SHELL RING

(71) Applicant: SNECMA, Paris (FR)

(72) Inventor: Denis Jean Maurice Sandelis, Nangis (FR)

(73) Assignee: SNECMA, Paris (FR)

( * ) Notice: Subject to any disclaimer, the term of this patent is extended or adjusted under 35 U.S.C. 154(b) by 0 days.

(21) Appl. No.: 14/394,214

(22) PCT Filed: May 23, 2013

(86) PCT No.: PCT/FR2013/051117
§ 371 (c)(1),
(2) Date: Oct. 13, 2014

(87) PCT Pub. No.: WO2013/175126
PCT Pub. Date: Nov. 28, 2013

(65) Prior Publication Data

US 2015/0059344 A1 Mar. 5, 2015

(30) Foreign Application Priority Data

May 25, 2012 (FR) ..... 12 54847

(51) Int. Cl.
*F02C 1/00* (2006.01)
*F23R 3/06* (2006.01)

(52) U.S. Cl.
CPC ..... *F23R 3/06* (2013.01); *F23R 2900/03041* (2013.01); *F23R 2900/03042* (2013.01); *F23R 2900/03044* (2013.01)

(58) Field of Classification Search
CPC ..... F23R 3/002; F23R 3/06; F23R 3/26; F23R 2900/03041; F23R 2900/03042; F23R 2900/03044; F23R 2900/00014
See application file for complete search history.

(56) References Cited

U.S. PATENT DOCUMENTS

| | | | | |
|---|---|---|---|---|
| 4,132,066 | A | 1/1979 | Austin, Jr. et al. | |
| 4,875,339 | A * | 10/1989 | Rasmussen | F23R 3/06 60/757 |
| 4,887,432 | A * | 12/1989 | Mumford | F23R 3/045 60/759 |
| 2007/0084219 | A1 | 4/2007 | Bernier et al. | |
| 2007/0227149 | A1 | 10/2007 | Biebel et al. | |
| 2009/0013530 | A1 * | 1/2009 | Rudrapatna | F23R 3/06 29/888 |

FOREIGN PATENT DOCUMENTS

| | | |
|---|---|---|
| FR | 2 404 110 | 4/1979 |
| FR | 2 892 180 | 4/2007 |
| FR | 2 899 315 | 10/2007 |

OTHER PUBLICATIONS

International Search Report Issued Mar. 5, 2014 in PCT/FR13/051117 Filed May 23, 2013.
French Search Report Issued Jan. 4, 2013 in French Patent Application No. 12 54847 Filed May 25, 2012.

* cited by examiner

*Primary Examiner* — Gerald L Sung
(74) *Attorney, Agent, or Firm* — Oblon, McClelland, Maier & Neustadt, L.L.P.

(57) ABSTRACT

A turbomachine combustion chamber shell ring in which dilution holes in the turbomachine combustion chamber shell ring are covered with inserts defining chambers around same on an inner face of the shell ring. Ventilation holes, through the insert, induce ventilation of portions of the shell ring surrounding the dilution holes, cool the portions, and prevent crack formation.

10 Claims, 2 Drawing Sheets

TURBOMACHINE COMBUSTION CHAMBER SHELL RING

BACKGROUND OF THE INVENTION

1. Field of the Invention

The present invention relates to a turbomachine combustion chamber shell ring.

The shell ring in question herein defines a flame tube, which is thus subject to considerable overheating on the inner face thereof, whereas the outer face thereof is crossed by a cool gas flow, originating from the turbomachine compressors and mixing with the combustion gases downstream from the shell ring before entering the turbines.

2. Description of the Related Art

Such a shell ring is traversed by a plurality of types of holes, including dilution holes having a relatively large diameter intended to allow the entry of a portion of the outer flow into the flame tube so as to improve the composition of the combustion mixture, and finer ventilation holes, which are more numerous and distributed on most of the surface area of the shell ring, to also enable the entry of air from the outer flow, but which have the effect of protecting the shell ring from overheating, by forming a flush flow in the downstream direction on the inner face of the shell ring and thus a boundary layer cooler than the combustion gases.

This boundary layer is reformed poorly downstream from the large diameter holes, interrupting the flush flow, and the corresponding portions of the shell ring, all or almost all subject to overheating, are subject to deformation and stress arising from differential expansions, which may give rise to cracks.

The document EP-A-1 703 207 describes a combustion chamber whereon the invention may be implanted. In addition, the above problems are mentioned in the French patent application registered under the number 11 53232 disclosing a modification of the conventional shell ring arrangement to reform the boundary layer immediately downstream from the large-diameter holes and thus relieve the shell ring. A further solution is however proposed with the present invention.

BRIEF SUMMARY OF THE INVENTION

In a general form, it relates to a turbomachine combustion chamber shell ring, comprising dilution holes and ventilation holes surrounding the dilution holes and finer and more numerous than said holes, characterised in that it comprises inserts extending over and around the dilution holes on an outer face of the shell ring, the shell ring is devoid of ventilation holes at portions situated above the inserts, the inserts each comprising an edge for attaching to the shell ring and an orifice extending over one of the respective dilution holes, and the inserts are traversed by holes directed towards said portions of the shell ring.

The essential effect obtained is that the high pressure present around the shell ring allows the entry of air via the holes of the insert, in streams striking the outer face of the shell ring and producing the sought cooling at this location, with a greater intensity than ventilation holes arranged through the shell ring, traversed very quickly by the air. Instead, the air sucked in below the insert flows on the outer face of the shell ring after reaching same, towards the dilution hole, and this flow time causes a greater elimination of heat. When the air enters the dilution hole, the relatively low speed driving same may make it possible for it to resume a tangent downstream direction relatively easily, which will help restore the boundary layer on the inner face of the shell ring and will enhance the ventilation further.

According to requirements, the inserts may be parallel with the shell ring or inclined relative thereto in an axial direction of the shell ring. The holes of the inserts are advantageously perpendicular to the shell ring, but they may also be positioned obliquely; all these adaptations are to be decided in each design.

Advantageously, the inserts extend more in the downstream direction of the shell ring than in other directions from the centres of the dilution holes, since the portions of the shell ring subject to intense overheating are specifically downstream from these holes. The inserts may however be subject to retraction in this downstream direction of the shell ring, since the boundary layer is reformed according to the same shape, bypassing the dilution holes.

A further favourable feature is obtained if the inserts each comprise an inner edge surrounding the respective orifice and extending towards the respective dilution passage, making it possible to channel both the air sucked in directly by the dilution holes via the insert orifice, and the air sucked in by the insert holes and blowing onto the shell ring, then flowing around this inner edge.

Satisfactory cohesion is obtained if the inner edge is enclosed between the attachment sectors situated in the respective dilution hole, flow sectors being defined in said respective dilution hole by the inner edge and between the attachment sectors. In order to help continue the flow on the downstream side of the dilution hole, more advantageously, the dilution holes and the inner edge have centres offset in an axial direction of the shell ring, such that the flow sectors have a main surface area downstream from the inner edge.

A further aspect of the invention is a turbomachine combustion chamber comprising such a shell ring.

BRIEF DESCRIPTION OF THE SEVERAL VIEWS OF THE DRAWINGS

The invention will now be described with reference to the following figures.

DETAILED DESCRIPTION OF THE INVENTION

Figure 1:
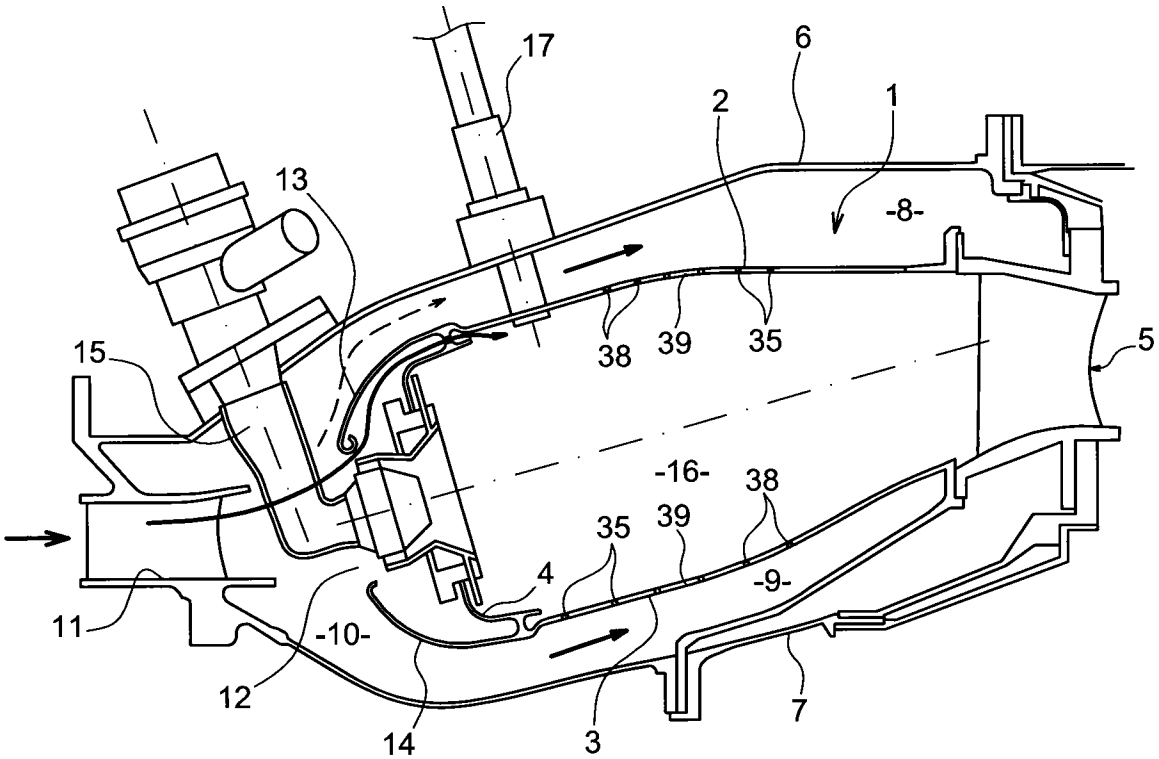
FIG. 1 is a general view of a turbomachine combustion chamber and the shell ring thereof.

A turbomachine combustion chamber where the invention may be present is represented schematically in FIG. 1. It should be noted that these combustion chambers are annular about the turbomachine axis, such that FIG. 1 is merely a half-section along the axis. A fillet 1 comprises an outer shell ring 2, an inner shell ring 3, both substantially conical and mutually concentric, and an annular chamber back face 4 joining the shell rings 2 and 3. The inner volume of the combustion chamber, forming a flame tube 16, is defined by the shell rings 2 and 3 and the chamber back face 4 and opens on the side opposite the chamber back face 4 via an opening 5. The combustion chamber is surrounded by an outer casing 6 and an inner casing 7 defining a flow stream 10 separated by the fillet 1 into two outer stream portions 8 and 9 bypassing and running along the fillet 1. The air of the flow stream 10 comes from a nozzle 11 situated opposite an opening 12 provided between rear fillets 13 and 14 of the shell rings 2 and 3 (in this description, "rear" and "front" refer to the direction of the air flow). Fuel injectors 15 extend through the outer casing 6, the opening 12 and the chamber back face 4 to the flame tube 16. Plugs 17 also traverse the outer casing 6 to the front of the fuel injectors 15 and also traverse the outer shell ring 1 to level with the flame tube 16. Most of the air flow thus follows the streams 8 and 9, even though a portion enters below the fillets 13 and 14 via the opening 12.

The shell rings 2 and 3 are traversed by numerous holes, including numerous fine ventilation holes 38 and less numerous larger diameter dilution holes 39, distributed on a circle or a small number of circles. The common effect of these holes is that of allowing air from the streams 8 and 9 to enter the flame tube 16 at a lower pressure for a variety of purposes.

The invention may be used on either of the shell rings 2 and 3.

Figure 2:
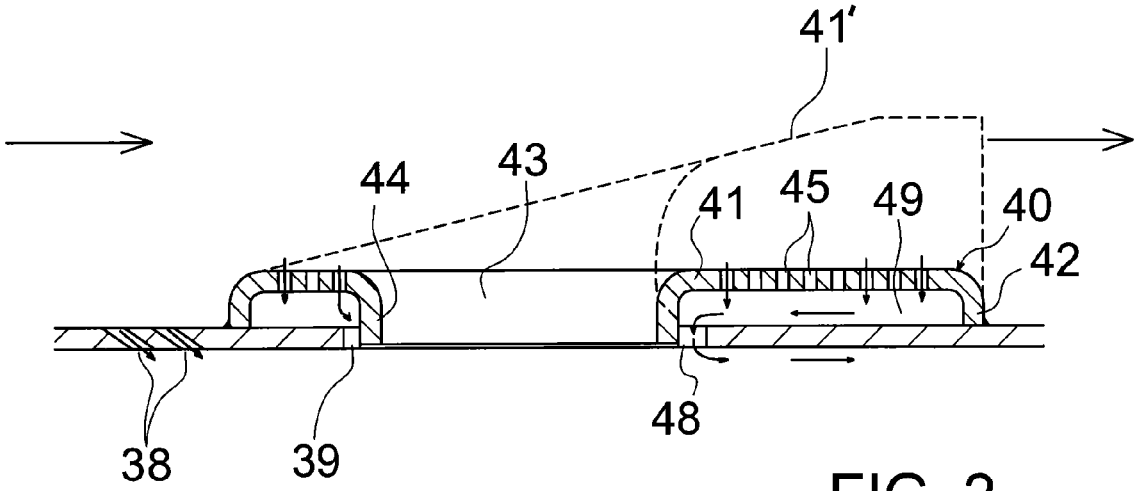
FIGS. 2 and 3 disclose the invention more specifically.
Figure 3:
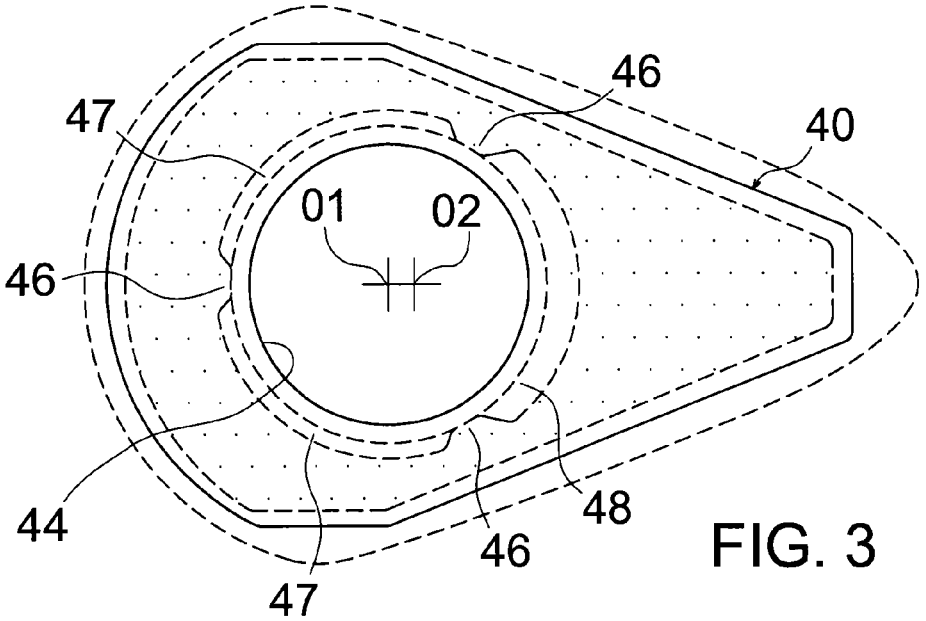

Remarks will now be made in relation to FIGS. 2 and 3. Inserts 40 are arranged on the outer face of the shell ring 2 or 3 and around the dilution holes 39. They each comprise a main portion 41 extending over the shell ring 2 or 3, an outer edge 42 surrounding the main portion 41 and attached to the shell ring 2 or 3, an orifice 43 extending in front of the respective dilution hole 39 but having a smaller radius, an inner edge 44 surrounding the orifice 43 and extending to most of the depth of the dilution hole 39, and holes 45 through the main portion 41 and opening in front of a portion facing the shell ring 2 or 3, which is devoid of ventilation holes 38 there. The insert 40 thus defines a chamber 49 almost closed in front of the shell ring 2 or 3 of the respective dilution hole 39. It can be seen in FIG. 3 that the insert 40 has a somewhat triangular general shape, extending more in the downstream direction of the flow while becoming increasingly narrow, so as to correspond as much as possible to the area of the shell ring 2 or 3 where cracks may appear. The dilution hole 39 is provided with attachment sectors 46 protruding towards the centre of said hole, touching and enclosing the inner edge 44. This inner edge 44 and the attachment sectors 46 define air flow sectors traversing the holes 45 of the inserts 40, including, herein, two symmetrical lateral sectors 47 in relation to an axial direction of the shell ring 2 or 3 and a downstream sector 48. It should be noted that the centres O1 and O2 of the inner edge 44 and the dilution hole 39 are axially offset, such that the sectors 47 or 48 have an irregular shape and the downstream sector 48 is wider, promoting the flow from the chamber 49 via this downstream sector 48 and the reconstruction of a boundary ventilation layer downstream from the dilution hole 39.

The specific flow provided by the insert 40 is as follows. Air from the flow of the flow of the stream 8 or 9 at a high pressure is blown into the chamber 49 via the holes of the inserts 45 and cools the shell ring 2 or 3 around the respective dilution hole 39, and particularly the portion downstream therefrom, via the outer face thereof. This air then flows into the flame tube 16 via the flow sectors 47 and 48 and particularly through same. On reaching the flame tube 16, the flow thereof may rapidly return to an axial direction downstream from the combustion chamber and reform a boundary layer in the above-mentioned area of the shell ring 2 or 3 downstream from the dilution hole 38 and helps protect same further.

The main portions 41 of the inserts 40 may be optionally parallel with the portion opposite the shell ring 2 or 3, and the holes 45 optionally perpendicular to this portion. The main portions 41 may particularly be inclined in relation to the shell ring 2 or 3, along the contour 41' rising in a downstream direction, to better intercept the flow air by creating a larger obstacle.

The invention claimed is:

1. A turbomachine combustion chamber shell ring, comprising:

dilution holes;

ventilation holes surrounding the dilution holes and being finer and more numerous than the dilution holes; and inserts extending over and around the dilution holes on an outer face of the shell ring, wherein the shell ring is devoid of ventilation holes at portions situated beneath the inserts, wherein the inserts each comprise an outer edge for attaching to the shell ring and an orifice extending over one of the respective dilution holes, and the inserts are traversed by holes directed towards the portions of the shell ring, and wherein the outer edge surrounds the holes traversing the inserts and the portions of the shell ring devoid of ventilation holes situated beneath the inserts.

2. A shell ring according to claim 1, wherein main portions of the inserts which comprise said holes are parallel with the shell ring.

3. A shell ring according to claim 1, wherein main portions of the inserts which comprise said holes are inclined in relation to the shell ring in rising in a downstream direction of the shell ring.

4. A shell ring according to claim 1, wherein the holes of the inserts are perpendicular to the shell ring.

5. A shell ring according to claim 1, wherein the inserts extend more in a downstream direction of the shell ring than in other directions from centers of the dilution holes.

6. A shell ring according to claim 5, wherein the inserts narrow in the downstream direction of the shell ring.

7. A shell ring according to claim 1, wherein the inserts each comprise an inner edge surrounding a respective of the orifices and extending through a respective of the dilution holes.

8. A shell ring according to claim 7, wherein the inner edge is enclosed between attachment sectors projecting in the respective of the dilution holes, flow sectors being defined in the respective of the dilution holes by the inner edge and the attachment sectors.

9. A shell ring according to claim 8, wherein the dilution holes and the inner edges have centers offset in an axial direction of the shell ring, such that flow sectors have a main surface area downstream from the inner edges.

10. A turbomachine combustion chamber comprising:

a shell ring;

the shell ring comprising dilution holes and ventilation holes surrounding the dilution holes and being finer and more numerous than the dilution holes; and inserts extending over and around the dilution holes on an outer face of the shell ring, wherein the shell ring is devoid of ventilation holes at portions situated beneath the inserts;

wherein the inserts each comprise an outer edge for attaching to the shell ring and an orifice extending over one of the respective dilution holes, and the inserts are traversed by holes directed towards the portions of the shell ring, and wherein the outer edge surrounds the holes traversing the inserts and the portions of the shell ring devoid of ventilation holes situated beneath the inserts.

* * * * *